US005121779A

United States Patent [19]

Green

[11] Patent Number: 5,121,779

[45] Date of Patent: Jun. 16, 1992

[54] FUNNEL

[76] Inventor: John Green, 204 S. Trail Ridge Rd., Edmond, Okla. 73034

[21] Appl. No.: 636,290

[22] Filed: Dec. 31, 1990

[51] Int. Cl.[5] ..... B65B 39/02; B67C 11/00

[52] U.S. Cl. ..... 141/337; 141/331; 141/390; 141/391

[58] Field of Search ..... 222/460–462, 222/566, 567, 526–530; 229/1.5 B, 1.5 R; 193/1, 2 R, 25 R; 141/391, 337, 390, 339, 331, 334; 4/144.2; 210/497.2, 497.3

[56] References Cited

U.S. PATENT DOCUMENTS

| | | | |
|---|---|---|---|
| 1,050,028 | 1/1913 | Jarratt . | |
| 2,006,036 | 6/1935 | Ware | 229/1.5 B |
| 2,100,888 | 11/1937 | Vine . | |
| 2,105,844 | 1/1938 | Reagan | 229/1.5 B |
| 2,105,949 | 1/1938 | Merta | 229/1.5 B |
| 2,129,498 | 9/1938 | Krein et al. | 229/1.5 B |
| 2,388,501 | 11/1945 | Schrader | 222/528 |
| 2,456,912 | 12/1948 | Burrows . | |
| 2,605,582 | 8/1952 | Allen | 141/391 X |
| 2,924,253 | 2/1960 | Beddow . | |
| 2,939,614 | 6/1960 | Hill | 222/460 X |
| 3,135,449 | 6/1964 | Kasper | 229/1.5 B |
| 3,181,742 | 5/1965 | Kebert | 222/527 |
| 3,983,914 | 10/1976 | Benson | 141/390 |
| 4,009,805 | 3/1977 | Klygis et al. | 222/530 |
| 4,062,387 | 12/1977 | Peniche . | |
| 4,108,222 | 8/1978 | Kaufman . | |
| 4,488,584 | 12/1984 | Hestehave et al. . | |
| 4,600,125 | 7/1986 | Maynard, Jr. . | |
| 4,751,751 | 6/1988 | Reno | 141/337 X |
| 4,896,707 | 1/1990 | Cowles | 141/337 |

*Primary Examiner*—Kevin P. Shaver
*Attorney, Agent, or Firm*—Young & Thompson

[57] ABSTRACT

A funnel comprises a flat sheet of resilient flexible material and has interengaging formations on opposite sides of the sheet whereby the sheet may be rolled to funnel configuration and the interengaging portions detachably interengaged with each other to hold the sheet in funnel configuration. The interengaging portions are stamped from the material of the sheet, and can comprise a slot on one side of the sheet and a tongue on the other side of the sheet, the tongue being detachably receivable in said slot, or they can comprise slits cut in marginal portions of the sheet and extending in opposite directions from each other, the slits being engageable one within the other thereby releasably to retain the sheet in funnel configuration. The interengaging portions have substantially point contact with each other, whereby the sheet may be formed by manual pressure selectively into a funnel of variable conicity. The sheet has top and bottom edges, and between the top and bottom edges pairs of opposite side edges which, beginning with the top edge, converge in the direction of the bottom edge, then diverge in the direction of the bottom edge, and finally converge in the direction of the bottom edge, whereby the sheet is of generally arrowhead configuration having wings defined between the last two pairs of opposite edges, the interengaging structure being located in the wings.

4 Claims, 2 Drawing Sheets

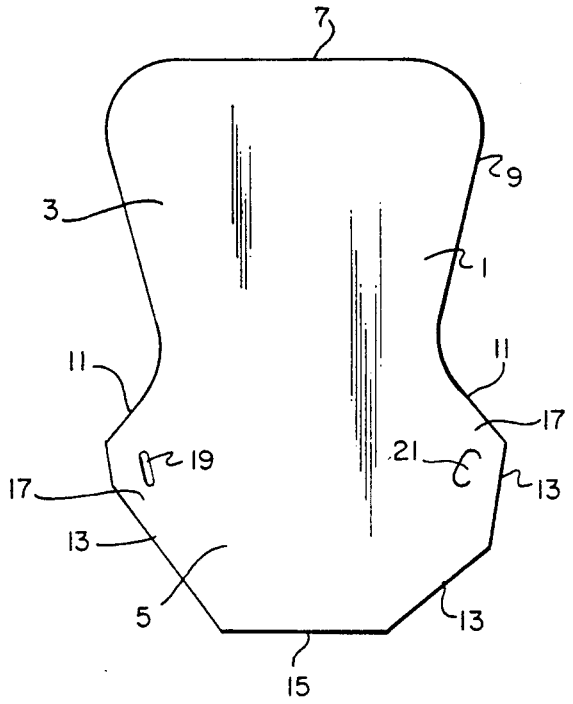
FIG. 1
FIG. 2
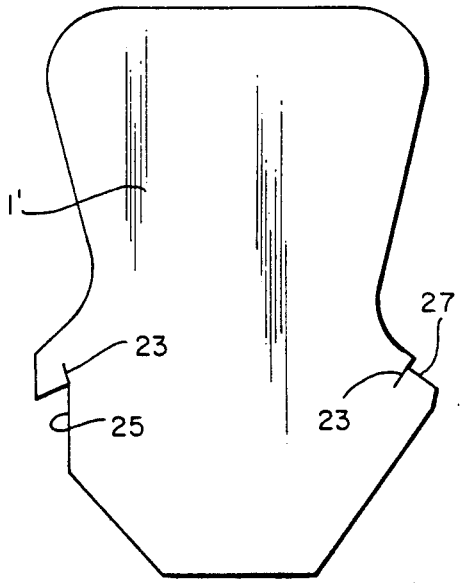
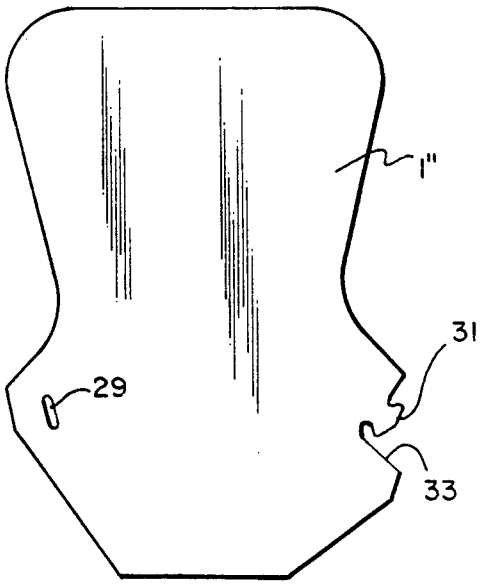
FIG. 3

FUNNEL

The present invention relates to funnels, more particularly funnels of the type that have interlocking portions that permit them to be stored in flattened condition and formed into a funnel shape at the time of use by the interengagement of interlocking portions that retain the funnel shape.

Funnels of this type are useful not only because they can be stored flat and formed to funnel shape only at the time of use, but also because they are so inexpensive that they can be discarded after a single use. Alternatively, the interlocking portions can be disengaged, the funnel wiped clean and stored flat for reuse.

Such funnels find use in every environment in which small portable funnels of more conventional types are used. Thus, they can be used for pouring automotive liquids such as oil, transmission fluid, antifreeze, washer fluid, battery fluid or gasoline. They can be used to fill the gas tanks of lawnmowers and chain saws. They can be used in kitchens or on boats, or for directing urine. In camping, they can be used for filling lanterns and cook stoves with kerosene, and can find many other uses where space and/or cost militate against the use of a conventional rigid funnel of fixed shape.

It is accordingly an object of the present invention to provide a funnel which is sufficiently inexpensive to be used once and thrown away.

Another object of the present invention is the provision of a funnel which can be shaped by the user to funnel shape and then, after use, dried and returned to a flattened storage condition.

Still another object of the present invention is the provision of a funnel which can be so shaped as to be adaptable selectively with wide-mouthed or narrow-mouthed receptacles.

Finally, it is an object of the present invention to provide a funnel which is simple in construction, easy to assemble to funnel shape, and rough and durable in use.

Other objects, features and advantages will become apparent from the following description, taken in connection with the accompanying drawings, in which:

FIG. 1 is a view in flattened condition of a first embodiment of a funnel according to the present invention;

FIG. 2 is a view similar to FIG. 1 but showing a modified form thereof;

FIG. 3 is a view similar to FIGS. 1 and 2 but showing a still further modified form thereof;

Figure 5:
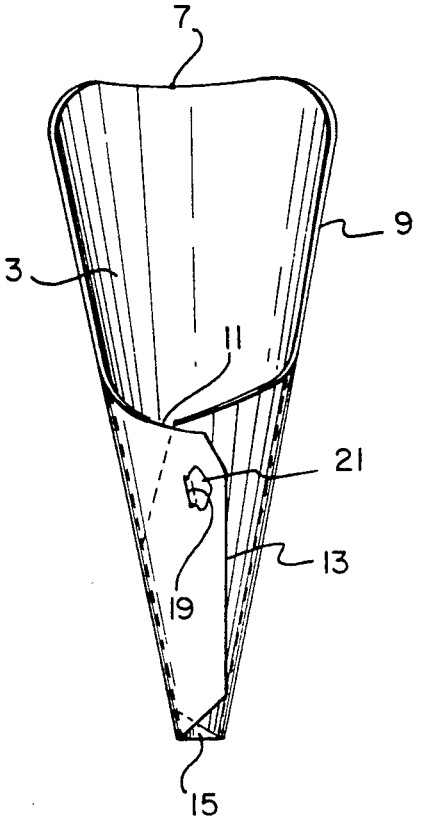
FIG. 5 is a view of the embodiment of FIGS. 1 and 4, assembled in a second funnel configuration.

Referring now to the drawings in greater detail, and first to the preferred embodiment of FIG. 1, there is shown a funnel according to the present invention which initially is in the form of a flat sheet 1 having an upper pouring portion 3 and a lower funneling portion 5. Sheet 1 is bounded by a top edge 7, and side edges 9 on opposite sides of upper pouring portion 3. Side edges 9 converge downwardly and terminate in side edges 11 that diverge downwardly and which in turn merge into side edges 13 which again converge downwardly. A bottom edge 15, which can be parallel to top edge 7, completes the boundary of sheet 1.

The downwardly diverging and converging edges 11 and 13, respectively, bound near their points of intersection laterally outwardly extending wings 17 on sheet 1.

Sheet 1 thus a generally keystone or arrowhead configuration. Preferably, top edge 7 is longer than bottom edge 15. It is also preferred that certain of the intersections between the edges be rounded or cut off, thereby to avoid the presentation of sharp corners.

The wings 17 are provided with means for detachably interconnecting them when the sheet 1 is rolled to funnel configuration, these means comprising a slot 19 in one wing 17, inclined at an acute angle to the vertical, and a coacting tongue 21 stamped in the other wing 17.

Figure 4:
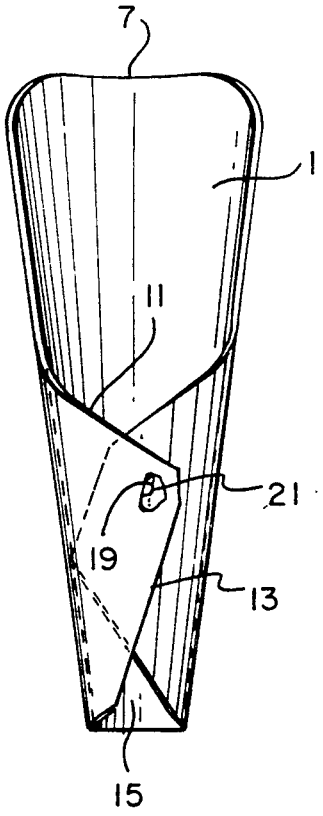
FIG. 4 is a view of the embodiment of funnel of FIG. 1, assembled in a first funnel configuration.

The slot 19 is intended to receive the tongue 21, thereby releasably to retain the sheet 1 in rolled or funnel configuration, as shown in either of FIGS. 4 or 5.

FIG. 4 thus shows the funnel when it is rolled into the configuration suitable for introducing liquids into a wide-mouthed container. In this condition, the downwardly converging taper of the funnel is much less than in the case of FIG. 5, in which the funnel is adapted for the introduction of liquids into a relatively small-necked container.

Notice that in the configuration of FIGS. 4 and 5, the upper pouring portion 3 provides a pouring shield or backsplash shield, against which the liquids can be initially directed so as to divert them thereafter into the lower funneling portion 5.

Notice also that the special configuration of the sheet 1, with downwardly converging edges 9 followed by downwardly diverging edges 11 and then downwardly converging edges 13, provides, in the rolled or funnel configuration, a shape of funnel which is well adapted to receive fluids poured from another container.

Notice particularly that the interaction of tongue 21 and slot 19 makes it possible with equal ease to form the funnel either into the FIG. 4 configuration or into the FIG. 5 configuration, because the margins of tongue 21 serve as fulcrum points for one or the other end of slot 19, whereby the funnel is held in rolled condition by what is essentially a point contact between the tongue 21 and an end of the slot 19. The wings 17 can thus swing relative to each other about this point of contact, so as to make it possible to shape the funnel either into the FIG. 4 configuration or into the FIG. 5 configuration, or of course into any configuration intermediate the two.

FIG. 2 shows a modified form of the present invention, in which the sheet 1' has an overall shape generally similar to that of the embodiment of FIG. 1, the recitation of whose configuration accordingly need not be repeated. Suffice it to point out that FIG. 2 differs from FIG. 1 with respect to the interengaging structure. In the embodiment of FIG. 2, the slot 19 and the tongue 21 are replaced by cuts 23 which preferably converge downwardly. The cut 23 on one side is in continuation of the edge of a recess 25 disposed downwardly of cut 23; whilst the cut 23 on the opposite side is in continuation of an edge of a recess 27 disposed above that cut 23.

As a result of the configuration of the cuts 23 and their corresponding recesses 25 and 27, the embodiment of FIG. 2 can be assembled to funnel shape in much the same way as the embodiment of FIG. 1, except that cuts 23 are brought into alignment with each other and caused to interfinger with each other. As in the case of the embodiment of FIG. 1, so also in the case of the embodiment of FIG. 2, this interengagement of the wings of the sheet 1' results in substantially point contact, at the closed end of each of the cuts 23, so that the embodiment of FIG. 2, like that of FIG. 1, can swing easily about this point of contact, between the positions of FIGS. 4 and 5.

The embodiment of FIG. 3 is characterized by a sheet 1" of substantially the same overall configuration as those of FIGS. 1 and 2, which accordingly need not again be described. The embodiment of FIG. 3 differs from the previous embodiments, only as to the interengaging means by which the sheet is releasably retained in funnel configuration. Specifically, in FIG. 3, a slot 29 is provided in one wing, the same as in FIG. 1; but in the other wing, on the other lateral side of sheet 1", a tongue 31 is provided which is not cut within the sheet as is tongue 21 in FIG. 1, but rather protrudes from the marginal edge of a recess 33 in the corresponding wing of sheet 1", and extends in the direction opposite to tongue 21 in FIG. 1. Apart from this, the structure and operation of the FIG. 3 embodiment are the same as those of FIG. 1; and again, the embodiment of FIG. 3 is adaptable to the FIG. 4 or FIG. 5 positions, simply by pivoting of an edge of tongue 31 about the substantially point contact provided by a corresponding end of slot 29.

From the foregoing, it will be apparent that the material of sheets 1, 1' and 1" should be flexible but sufficiently resilient to be self-sustaining when rolled to funnel shape and sufficiently rigid to avoid ready creasing or undesired bending. Thus, the sheets should have a normally flat configuration, but when configured in the position of FIG. 4 or FIG. 5, should provide a structure of sufficient rigidity to function as a funnel without collapsing under the weight of the liquid being poured. To this end, therefore, the funnel should have the stiffness and resilience of resilient sheet plastic or resilient heavy paper.

It follows, therefore, that the material of the sheet should be preferably plastic, such as polyethylene, polypropylene, polyester, etc., of adequate rigidity and resilience, and which will also be inert to all the liquids normally poured through funnels, so that the funnel after use can be returned to its flattened condition and wiped dry to clean it, whereupon it can be stored flat for the next use. Alternatively, of course, the funnel can be discarded after one use, as it is sufficiently inexpensive that it may not be worth the trouble to clean and keep.

Other materials for the sheet may be used, such as heavy paper which has been impregnated or coated with wax or a plastic so as to render it liquid-proof; however, all-plastic construction is preferred.

The sheets can be easily produced by a single stamping operation.

Needless to point out, a supply of the funnels can be stacked in a small space; and the individual funnels, when flat, can be kept in places such as a glove compartment in which a permanently assembled funnel would be too bulky.

The flattened sheets can also bear advertising materials, in which case they can be distributed free, as at gasoline service stations, auto supply stores and the like.

From the foregoing disclosure, therefore, it will be evident that all of the initially recited objects of the present invention have been achieved.

Although the present invention has been described in connection with preferred embodiments, it is to be understood that modifications and variations may be resorted to without departing from the spirit of the invention, as those skilled in this art will readily understand. Such modifications and variations are accordingly considered to be within the purview and scope of the present invention as defined by the appended claims.

What is claimed is:

1. A funnel comprising a flat sheet of resilient flexible material, and interengaging portions on opposite sides of the sheet whereby the sheet may be rolled to funnel configuration and the interengaging portions detachably interengage with each other to hold the sheet in funnel configuration, said sheet having top and bottom edges, and between said top and bottom edges pairs of opposite side edges which, beginning with said top edge, converge in the direction of said bottom edge, then diverge in the direction of said bottom edge, and finally converge in the direction of said bottom edge, whereby said sheet is of generally arrowhead configuration having wings defined between the last two pairs of opposite edges, said interengaging portions being located in said wings.

2. A funnel as claimed in claim 1, in which said interengaging portions are stamped from the material of the sheet.

3. A funnel as claimed in claim 2, in which the interengaging portions comprise a slot on one side of the sheet and a tongue on the other side of the sheet, said tongue being detachably receivable in said slot.

4. A funnel as claimed in claim 2, in which said interengaging portions comprise slits cut in marginal portions of the sheet and extending in opposite directions from each other, said slits being engageable one within the other thereby releasably to retain the sheet in funnel configuration.

* * * * *